United States Patent [19]

Maguire

[11] Patent Number: 4,680,821

[45] Date of Patent: Jul. 21, 1987

[54] SHEET BEDDING CONSTRUCTION FOR INSTITUTIONAL USE

[76] Inventor: Sara B. Maguire, 1952 Port provence, Newport Beach, Calif. 92660

[21] Appl. No.: 674,986

[22] Filed: Nov. 26, 1984

[51] Int. Cl.[4] ..... A47C 29/00; A47G 9/02

[52] U.S. Cl. ..... 5/413; 5/485; 5/494; 5/496

[58] Field of Search ..... 5/413, 485, 494–500

[56] References Cited

U.S. PATENT DOCUMENTS

| | | | |
|---|---|---|---|
| 1,952,465 | 3/1934 | Rycroft | 5/413 |
| 2,498,055 | 2/1950 | Veit | 5/500 |
| 2,525,713 | 10/1950 | North | 5/494 |
| 2,772,425 | 12/1956 | Brodie | 5/497 |
| 3,789,546 | 2/1974 | Morrison | 5/485 |
| 4,197,601 | 4/1980 | Maguire | 5/497 |
| 4,304,018 | 12/1981 | McClam | 5/494 |
| 4,413,368 | 11/1983 | Schuetze | 5/494 |

FOREIGN PATENT DOCUMENTS

| | | | |
|---|---|---|---|
| 2072007 | 9/1981 | United Kingdom | 5/500 |

*Primary Examiner*—Gary L. Smith
*Assistant Examiner*—Michael F. Trettel
*Attorney, Agent, or Firm*—Stetina and Brunda

[57] ABSTRACT

An improved sheet bedding construction for institutional use is described which includes a bottom sheet of cloth material the head portion of which is adapted to be non-elastically fitted over the two corners of the head portion of a mattress, the ends of which are coextensive with the head portion and the sides of the head portion of the mattress, a foot portion which forms the bottom part of a bag-like portion for the user's feet, the ends of which are coextensive with the foot portion of the mattress, and, further having a pair of loops formed of elastic material adapted to fit about each of the corners of the foot portions of a mattress, the median bottom and top sheet portions of which are coextensive with the mattress and extend beyond the sides of the mattress, a top sheet generally coextensive with the top of the mattress and sewn to the foot portion of the bottom sheet to form the top part of the bag for the feet, and the foot portion of the top and bottom sheets forming an expandable bag for the user's feet.

8 Claims, 9 Drawing Figures

DETAIL A

SHEET BEDDING CONSTRUCTION FOR INSTITUTIONAL USE

BACKGROUND OF THE INVENTION:

1. Field of the Invention:

The instant invention relates to institutional bedding and the like, and, more particularly, to a new and novel construction therefor whereby a pair of sheets are sewn in a unitary fashion and arranged to form lengthwise half-sleeping bag with an expandable foot pocket whereby a bed can be made up for use by a patient, or an institutional inmate, in a substantially shorter period of time than the period of time which is typically necessary for the normal two separate sheets and a pillow bedding arrangement and which can also be used in conjunction with a mattress such as typically found in mobile recreational vehicles such as trailers and motorhomes.

2. Description of the Prior Art:

The prior art involving and including institutional bedding for humans has largely been of the two separate sheets and a pillow arrangement and has been widely used in the prior art, especially for institutional and commercial use in hospitals, hotels, motels, and the like.

However, in recent years, such a bedding arrangement has drawn a significant amount of criticism because it involves a substantial amount of labor and time to make up a bed, to tear it apart, to launder it, and to sort and inventory it for re-use.

Additionally, when used in conjunction with an elevatable bed, the bedding becomes loose and difficult to arrange for proper application and use as sanitary and comfortable bedding.

Further, the use of conventional sheets and a separate pillow with a pillow case is typically undesirable because of the extra storage required due to these separate items, the strong likelihood of missing one or more sheets of a matching pair of bottom and top sheets, and the time consuming jobs of making and unmaking a bed with a mattress and its associated separate sheets and pillow/pillow case combinations. Consequently, it is highly desirable, for both convenience and sanitary reasons, to have but a single unitary sleeping enclosure for use with a mattress in such a setting.

One example of such prior art as is found in this particular field of endeavor includes that which is disclosed and exemplified by the sleeping bag found in U.S. Pat. No. 2,239,017 (Roberts) wherein such is used as a sanitary covering for a children's bed wherein the child is kept covered at all times while asleep.

Sleeping bags are noted for both their convenience and sanitary purposes, and, as such, are highly desirable.

One of the problems frequently encountered with prior art sleeping bag constructions is that the sanitary liner does not incorporate means for similarly providing sanitary protection for the pillow as well.

Another problem which frequently manifests itself in sleeping bags typically found in the prior art is that the bottom portion of the bag which is where the user's feet are placed is uncomfortably confining and unduly restricts the movement thereof.

Construction of prior art sleeping bags is relatively complex and labor intensive. Labor intensive construction typically results in higher, and unacceptable, costs to produce the sleeping bags.

While sleeping bag construction offers highly desireable features over the prior art two sheets and a pillow arrangement, it is generally unacceptable for use as institutional bedding because it is too confining to the users thereof.

For example, the simplest sleeping bag construction involves the seaming of two coextensive sheets together along the foot of the bag. However, when the person crawls therebetween, the upper sheet is elevated, opening the sides of the bag and uncovering the user thereof. Additionally, the seams form right angles with each other, which requires that the sewing machine operator stop sewing, move and reorient the sheets to be seamed and then seam them along another line. Such a procedure is both time consuming and increases the cost of such an article of manufacture. Further, the securing of the stretch tapes diagonally across the underside of the corners requires that the operator perform multiple sewing passes to sufficiently anchor the ends of the stretch tapes to the edges of the seamed sheets, all of which involved costly additional time and expense.

More recently, use of sleeping bags has found wide spread use in conjunction with various modern day recreational vehicles. Prior art sleeping bags opened only along one side of the bag to permit the user ingress and egress therefrom. When a sleeping bag is used on top of a mattress in such a recreational vehicle, the bag may open along the wrong side of the bed such as the side facing the wall instead of the walkway. Additionally, such prior art sleeping bags failed to provide means for securing the sleeping bag to the mattress upon which the sleeping bag is placed.

Still further, it is highly desirable for the sleeping bag used in this fashion to be quickly secured to the mattress so as to be ready for use and, at the same time, readily removable therefrom for purposes of washing and sanitizing such a sleeping bag.

Another example of the prior art is found in U.S. Pat. No. 4,197,601 which is issued to the inventor herein. Such sleeping bag bedding construction does incorporate many desirable features overcoming many of the undesirable features of the art previous to it in sleeping bag construction, nevertheless, more recently, it has been found that such sleeping bag construction fails to provide:

(1) An integral pillow pocket which is controllably accessible from either ends thereof;

(2) For a bottom sheet and the top sheet which are not essentially coextensive with the mattress to which it is secured;

(3) The elimination of elastic bands near the pillow pocket portion thereof;

(4) Tie straps so that the sleeping bag can be rolled up and easily secured thereabout to maintain it in a rolled up condition with the tie straps.

Not only are these benefits provided by the present invention but more by the present improved institutional bedding construction, as enumerated as follows:

(1) A pillow may be easily inserted or removed from either end of the integral pillow pocket. Once inserted, elastic material sewn into and along the pillow pocket edges provide a closure bias to hold the pillow in the pillow pocket. This eliminates the loss of the pillow during a restless sleep wherein the user/sleeper engages in a substantial amount of movement while sleeping.

(2) The present invention includes a bottom sheet which extends beyond the mattress to ensure that the sleeper's arms do not touch and perhaps soil the edge of the uncovered mattress during use.

(3) Elimination of the elastic bands at the head portion of the sleeping bag which secures the bag to the mattress which eliminates the possibility of a broken elastic strap hitting the face of the sleeper during the sleeping process which could result in serious facial or eye injury. These two corners are seamed to fit over the two corners at the head of the mattress. The non-elastic arrangement eliminates this highly undesireable problem.

(4) Roll-up tie straps are provided to allow the sleeping bag to be rolled up and secured without securing separate tying means therefor. Additionally, by color coding the tie straps, a particular person's sleeping bag can be easily idenified before the sleeping is unraveled to check its size and length.

(5) Mediately of the institutional bedding in the form of a semi-bag, a portion of the lower sheet is provided which extends beyond the bottom edge of the mattress to protect the mattress from soil attributed to the user's legs while entering the sleeping bag or in simply sitting on the edge of the mattress.

(6) This same lower sheet's intermediate extension offers the user the opportunity to tuck this extension material underneath the mattress so that when the head portion or the lower portion of the mattress is elevated, the bottom sheet which covers the mattress is held firmly reinforcing its proper place.

After much thought, experimentation and effort, the present invention disclosed herein was devised to overcome the significant disadvantages such as typifies the prior art institutional bedding.

SUMMARY OF THE INVENTIONS AND OBJECTS:

Fundamentally, the present invention disclosed herein is an improved institutional bedding in the form of a semi-full bag construction which includes a bottom sheet of cloth material the head portion of which is adapted to be non-elastically fitted over the two corners of the head portion of a mattress, the ends of which are coextensive with the head portion and the sides of the head portion of the mattress, a foot portion which forms the bottom part of a bag-like portion for the user's feet, the ends of which are coextensive with the foot portion of the mattress, and, further having a pair of loops formed of elastic material adapted to fit about each of the corners of the foot portions of a mattress, the intermediate bottom and top sheet portions of which are coextensive with the mattress and extend beyond the sides of the mattress, a top sheet generally coextensive with the top of the mattress and sewn to the foot portion of the bottom sheet to form the top part of the bag for the feet, and the foot portion of the top and bottom sheets forming an expandable bag for the user's feet.

It is an important and primary object of the invention herein to provide an institutional bedding construction using a semi-full bag for use with a mattress of the type herein characterized by simple construction.

Another important and primary object of the instant invention is to provide an institutional bedding construction with a non-elastic means for securing the head portion thereof to the corners of the head portion of the mattress.

A yet still further primary object of the invention is to provide an improved institutional bedding construction using a semi-full bag having an integral pillow pocket therein which is controllably accessible from either end thereof and which captures the pillow therein to prevent inadvertant removal therefrom especially during sleeping.

Another important and primary object of the invention is to provide an improved institutional bedding construction using a semi-full bag with a laterally extended head portion along the opposite sides of the bottom sheet so that the side edges of the mattress are covered to prevent soiling of the mattress.

It is yet a still further and important object of the instant invention to provide an improved institutional bedding construction using a semi-full bag having a bottom sheet with extended portions along opposite sides of the mediate section whereby the length of the portions extend below the mattress to prevent soiling of the mattress by contact with the legs of the user of the mattress.

Another object of the instant invention disclosed herein is to provide an improved institutional bedding construction in the form of a semi-full bag having a pair of mediately disposed extensions thereon which offer the user the opportunity to tuck said extensions underneath the mattress so that when the head portion of the mattress or the bottom portion of the mattress is elevated, the bottom sheet which covers the mattress is held firmly into its proper place.

These and other objects, features and many of the attendant advantages of this invention will be appreciated more readily as the subject invention becomes better understood by reference to the following detailed description, when considered in connection with the accompanying drawings, wherein like parts in each of the several figures are identified by the same reference character, and wherein:

Figures 1, 2, 3, 4:
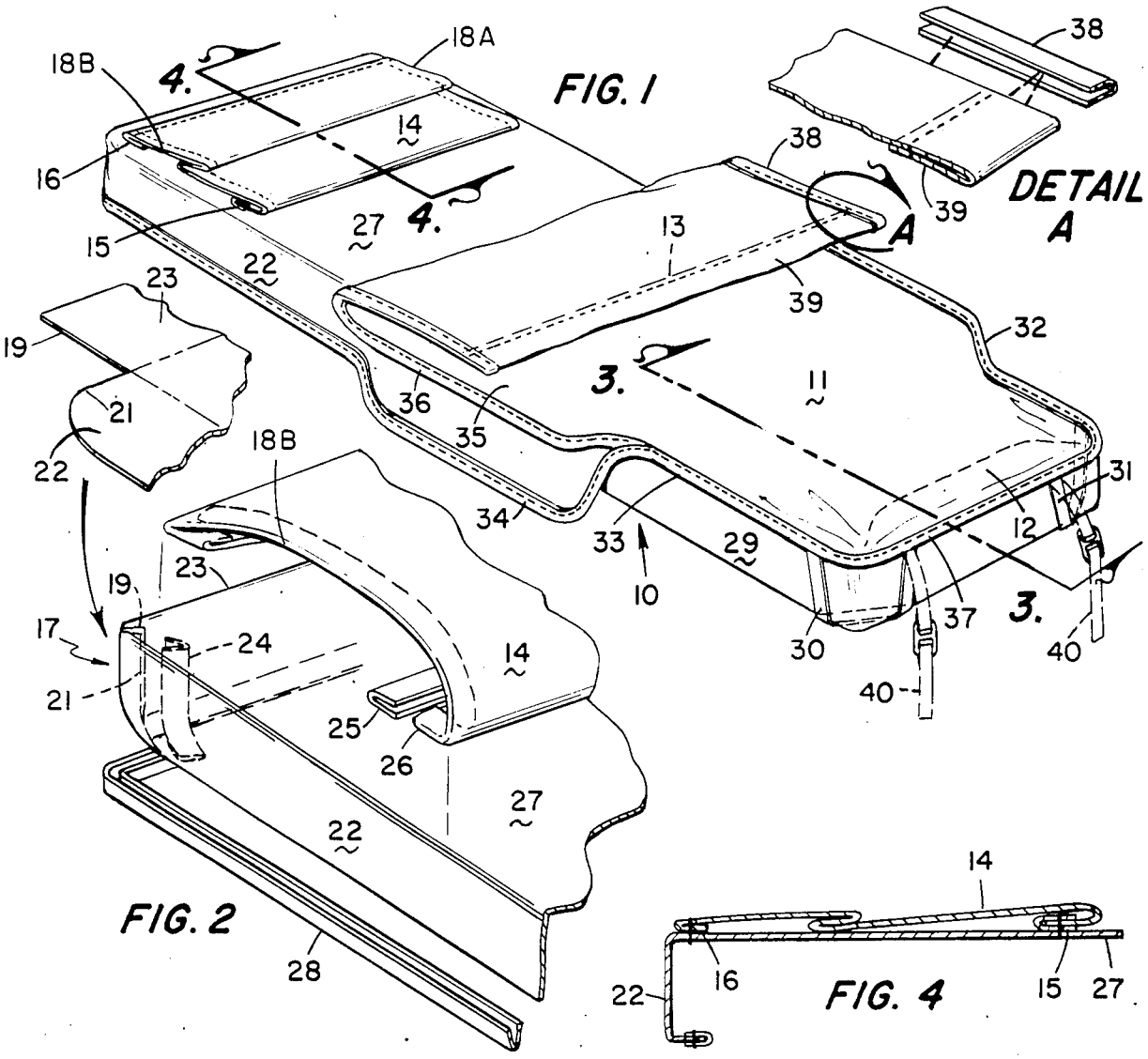
FIG. 1 is a perspective view of the improved institutional bedding using the semi-full bag construction method disclosed herein.
FIG. 2 is an enlarged detailed view of an edge portion of the pillow pocket portion of the invention characterized and shown herein, and, further, showing the construction of one of the top (head) portions thereof.
FIG. 3 is an enlarged section of one bottom corner of the new and improved institutional bedding using the semi-full bag construction means illustrated herein.
FIG. 4 is a view of the pillow portion of the present invention taken along Plane 4—4 of FIG. 1.

Detail A is an enlarged view of the construction shown at A of the institutional bedding using the semi-full bag construction method shown and illustrated in FIG. 1.

Figure 5:
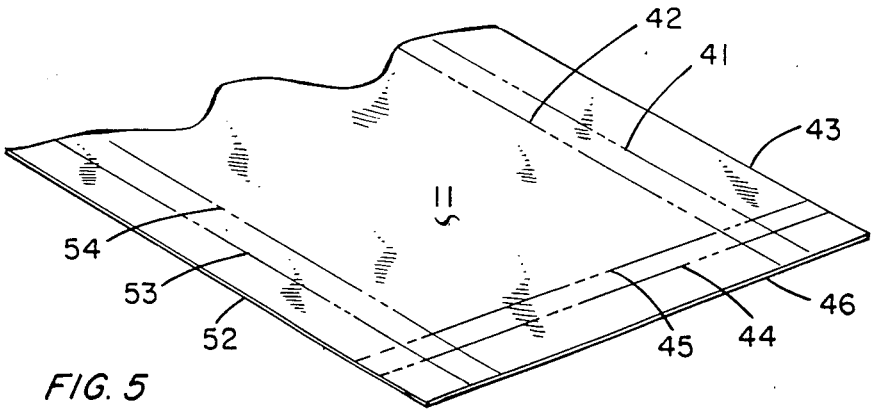

FIG. 5 is a first view of the top sheet, in the flat, prior to any folding in order to create the expandable foot pleat portion of the institutional bedding construction disclosed herein, depicting the location of the fold lines.

Figure 6:
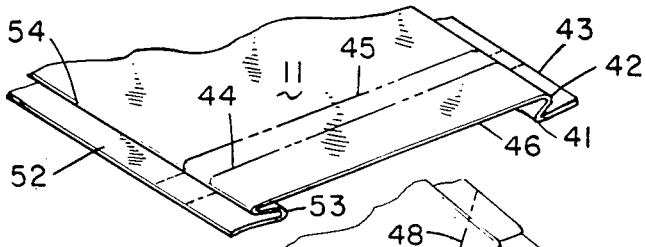

FIG. 6 depicts the second view of the top sheet's construction in forming the expandable foot bag showing the first actual fold taken from its original unfolded and flat condition and arrangement as shown and depicted in FIG. 5.

Figure 7:
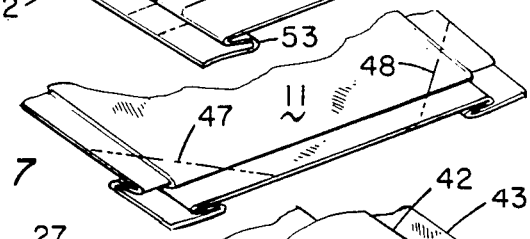

FIG. 7 depicts the third view of the second actual folding step taken following its first folding step and arrangement as previously shown and depicted in the second view of the top sheet from FIG. 6.

Figure 8:
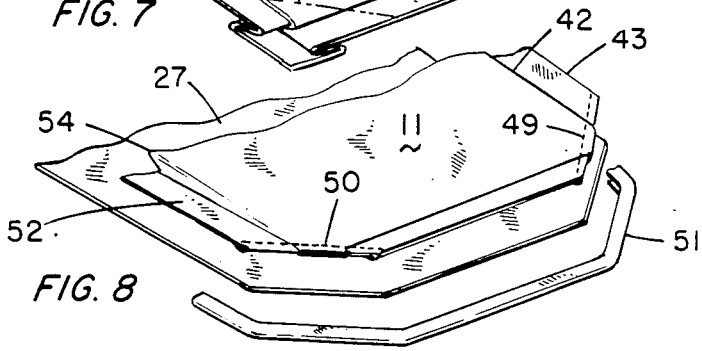

FIG. 8 depicts the fourth view of the third actual folding step taken following its second folding step and arrangement as previously shown and depicted in the third view of the top sheet from its second fold condition and arrangement as shown and depicted in FIG. 7.

Figure 9:
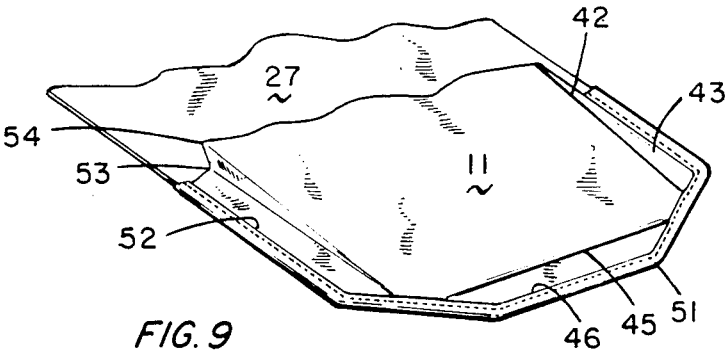

FIG. 9 depicts the final view of the completed sewing of the top folded sheet to the bottom unfolded sheet with the reinforcing piping thereabout.

DESCRIPTION OF THE PREFERRED EMBODIMENT:

With continued reference to the drawings herein, and with special emphasis now on FIG. 1 thereof, the improved institutional sheet bedding construction is generally shown at 10, including a bottom sheet 27 formed of cloth material, the head portion of which is adapted to be fitted to the two corners of the head portion of a mattress 29 and whose ends of which are coextensive with the head portion and the sides of the head portion of the mattress 29, a foot portion which is formed into part of a bag 12 for the user's feet, the ends of which are coextensive with the foot portion of the mattress 29 and having a pair of loops 30, 31 formed of elastic material about each of the corners of the foot portions of the mattress 29 and extends beyond the sides of the mattress 29, and sewn to the foot portion of the bottom sheet 27 to form the other part of the bag 12 for the feet, and a pillow pocket 14 having at least one open end thereinto secured to the head portion of the bottom sheet 27.

As can be readily seen from the detailed illustration of the improved institutional bedding construction of FIG. 1, the head portion of the bottom sheet 27 includes two sewn corners which are mateable over the two corners of the head of the mattress 29. This is accomplished by forming the corners as illustrated in enlarged detail form in FIG. 2 of the drawings. A rectangular cut is made in the corner of the bottom sheet 27, along with a small beveled cut up to the intersection of the fold lines 20, 21 which forms edges 18, 19. These edges are then covered with a piece of reinforcing piping 24 and then sewn to form a completed corner to mate over the corner of the mattress 29. Both corners of the head portion of the bottom sheet 27 are constructed in this fashion.

Reinforcing piping 28 is sewn over the ragged, raw cut edge of the material forming the bottom sheet 27 to prevent unravelling of the cut edge.

In fact, reinforcing piping 24, 25, 33, and 36 is sewn over all of the edges of the sleeping bag 10 where the edges are not turned over onto each other and are sewn together to both provide both reinforcement of the edges and to prevent unravelling of the edge of the cloth.

Over the head portion of the bottom sheet 27, a pillow pocket 14 is sewn into place on the bottom sheet 27 along its upper edge at 16 and along its innermost edge 26, with reinforcing piping 25 along 15. At the opposite open ends of the pillow pocket 14 are elastic bands 9A and 9B sewn into the free edges of the pillow pocket to provide an elastic partial closure of the ends of the pillow pocket 14 with respect to the bottom sheet 27. The closure is sufficient so that once the pillow (not shown) is located therein, the pillow will not be accidentally dislodged from the pillow pocket 14.

The top sheet 11 is sewn together with the bottom sheet 27 to form a bag 12 for the user's feet.

Mediately disposed of the top sheet 11 is an extended portion 35 which provides for an extra portion of the cloth necessary to accomodate the larger hip and middle torso portions of the human body so that when the user is in the sleeping bag 10 the edge of the top sheet 11 will not be raised above the user's body so as to expose it to another person's view and, perhaps, the uncomfortable coolness of the night air. In this way, sufficient additional cloth is provided to ensure that the user's body is covered.

The mediate portion of the bottom sheet 27 is an extended portion 34 which extends below and beyond the mattress edge so that the legs of the user of the sleeping bag 10 are not permitted to come into contact with the mattress 29 so as to soil it.

The forwardmost upper edge 39 of the top sheet is formed and reinforced by overlapping and then sewing the overlapping portion along 13. Such an overlapping edge 39 provides a durable, long-wearing edge.

As shown in Detail A of the drawings, the reinforcing piping 38 is sewn along the edge of the top sheet 11 and over the overlapped portion 39.

FIG. 3 provides an exploded assembly view of the pertinent construction details of one of the bottom corners showing how the elastic corner 31, piping 37, 32 are used in joining the top 11 and bottom 27 sheets together along the outermost edges thereof. It should be noted that a pleated portion, that is, an extra fold of the material forming the foot portion of the top sheet 11, is provided in order to provide a natural expansion of the foot portion of the sleeping bag 10 to accomodate larger feet.

Tie straps 40 may be added as the elastic straps 30, 31 are sewn onto the bottom 27 and top 11 sheets. Such tie straps 40 may be tied back onto each other after encompassing the rolled up sleeping bag 10 to provide for compact storage of the sleeping bag 10 prior to use. Also, such storage prevents the inside of the sleeping bag 10 from getting soiled prior to sleeping in it.

With special reference now to FIGS. 5 through 9, inclusive, there is depicted in FIG. 5, the top sheet 11 of the present novel construction previously described herein. There is depicted on said sheet 11 displayed in substantially parallel relationship with the edges 43, 46 and 52 of the sheet 11, a plurality of anticipated fold lines as more specifically identified as 41, 42, 44, 45 and 53, 54. As is to be clearly noted, fold lines 41, 42 are parallel to edges 43 and 52 of sheet 11. On the other hand, fold lines 44, 45 are not parallel to sheet edges 43, 52 but are, instead, substantially perpendicular thereto. However, fold lines 44, 45 are disposed in substantial parallel relationship to edge 46 of sheet 11.

The first folding steps in creating the expandable foot bag are shown clearly in FIG. 6, wherein the pair of tuck folds are made along the fold lines 41, 53 and 42, 54 simultaneously in one quick and convenient step.

Next, as shown and illustrated in FIG. 7, another tuck fold is made along fold lines 44, 45. Once this is accomplished, fold lines 47 and 48 can be used to define the corners of the foot bag. Once this is accomplished, the corners are sewn to hold them in position.

The last step in the completion of the foot bag is accomplished by sewing the piping 51 onto and about the edge thereof as shown in FIG. 9.

Without further analysis, the foregoing will so fully reveal the gist of the present invention that others can, by applying current knowledge, readily adapt it for various applications, without omitting features that, from the standpoint of prior art, fairly constitute essential characteristics of the generic and specific aspects of the aforedescribed contribution to the art, and, therefore, such adaptations should and are intended to be comprehended within the meaning and range of equivalence of the claims.

What I claim is:

1. An article of improved institutional bedding construction adapated to be used in combination with a substantially rectangularly shaped mattress having eight corners, four of the corners being on the upper portion of the mattress and the other four corners being on the bottom portion, comprising:

(a) a bottom sheet of substantially rectangularly shaped cloth material, having a head portion, an intermediate portion and a foot portion each of said head and foot portions having a pair of corners thereon, the head portion having a pair of sewn corners therein conformably mateable to the pair of corners disposed at the top of the head portion of the mattress so as to be fitted thereover, and further having along either side of the head portion of the bottom sheet a pair of edges extending below the head portion of the sheet that can cover the corresponding portion of the mattress from contact with the body of the user thereof so as to prevent soiling thereof, a further pair of elongated portions mediately disposed of the bottom sheet portion and extending adjacently below the pair of edges to provide full coverage of the mattress edge to prevent soiling of the mattress by contact with the user of the article of improved institutional bedding construction, and a foot portion which is substantially coextensive with the top of the foot portion of the mattress the elongated portions being formed as a second pair of edges substantially contiguous with and between said pair of edges and the foot portion;

(b) a top sheet of cloth material substantially coextensive with the bottom sheet, the top sheet being joined along the edges of its foot portion with the edges of the foot portion of the bottom sheet to form a bag for the user's feet; and (c) a pair of elastic loops sewn into the bottom and side edges of the top and bottom sheets so as to be disposed in a diagonal fashion across the corners thereof for elastic engagement with the corners of the foot of the mattress to secure the bag portion of the sleeping bag in conformal engagement with the corners at the head of the mattress into more intimate engagement therewith.

2. The improved institutional bedding construction of claim 1, further comprising a pillow pocket secured to the head portion of the bottom sheet, and having open ends laterally disposed with respect to the length of the bedding, to receive a pillow therein, said open ends having elastic material sewn therein so that the pillow, once inserted therein, cannot easily slide therefrom.

3. The improved institutional bedding construction of claim 2 further comprising reinforcing piping sewn along the free edges of the bottom and top sheets of the institutional bedding construction.

4. The improved institutional bedding construction of claim 1 further including reinforcing piping sewn along the joined edges of the bottom and top sheets of the institutional bedding construction.

5. The improved institutional bedding construction of claim 1, further comprising a pair of tie straps having buckles thereon for back tying the free end of the straps to the body of the straps, one end of which is sewn along the bottom of the foot portion of the institutional bedding construction, so that when the bedding is rolled up the tie straps may be looped thereabout and tied to keep the bedding in a rolled up condition for storage purposes and to prevent soiling of the inside thereof during storage.

6. The improved institutional bedding construction of claim 1, further including a portion having multiple folded sections at the foot of said construction whereby the foot portion can expand to accomodate the user's feet without any substantial restriction thereto.

7. The improved institutional bedding construction of claim 6, wherein said foot portion of said construction includes:

(a) a flat top sheet having a generally rectangular foot portion;

(b) a first fold having a pair of fold lines substantially parallel to one side edge thereof whereby a portion of said side edge is tucked under a portion of said sheet;

(c) a second fold having a pair of fold lines substantially parallel to the side edge of said sheet which is oppositely disposed in parallel relationship to said first fold whereby a portion of said side edge is tucked under a portion of said sheet;

(d) a third fold having a pair of fold lines substantially parallel to the bottom edge of said sheet which is disposed in substantial perpendicularity with said first and second folds herein;

(e) a pair of corner folds the outer facing edge of which is disposed at a substantially forty-five degree angle with respect to the edge formed along the bottom of said folded sheet; and (f) means for securing said foled portion of said sheet in substantially fixed position relative to each other of said folds after folding to form an expandable foot bag for said construction.

8. An article of improved institutional bedding construction adapated to be used in combination with a substantially rectangularly shaped mattress having eight corners, four of the corners being on the upper portion of the mattress and the other four corners being on the bottom portion, comprising:

(a) a bottom sheet of substantially rectangularly shaped cloth material, having a head portion, an intermediate portion and a foot portion each of said head and foot portions having a pair of corners thereon, the head portion having a pair of sewn corners therein conformably mateable to the pair of corners disposed at the top of the head portion of the mattress so as to be fitted thereover, and further having along either side of the head portion of the bottom sheet a pair of edges extending beyond the top portion of the mattress and over the thickness thereof to cover the mattress from contact with the body of the user thereof so as to prevent soiling thereof, a further pair of elongated portions mediately disposed of the bottom sheet portion and extending beyond the mattress to provide full coverage of the mattress edge to prevent soiling of the mattress by contact with the user of the article of improved institutional bedding construction, and a foot portion which is substantially coextensive with the top of the foot portion of the mattress;

(b) a top sheet of cloth material substantially coextensive with the bottom sheet, the top sheet being joined along the edges of its foot portion with the edges of the foot portion of the bottom sheet to form a bag for the user's feet;

(c) a pair of elastic loops sewn into the bottom and side edges of the top and bottom sheets so as to be disposed in a diagonal fashion across the corners thereof for elastic engagement with the corners of the foot of the mattress to secure the bag portion of the sleeping bag in conformal engagement with the corners at the head of the mattress into more intimate engagement therewith;

(d) a pillow pocket secured to the head portion of the bottom sheet, and having open ends laterally disposed with respect to the length of the bedding, to receive a pillow therein, said open ends having elastic material sewn therein so that the pillow, once inserted therein, cannot easily slide therefrom;

(e) reinforcing piping sewn along the joined edges of the bottom and top sheets of the institutional bedding construction;

(f) reinforcing piping sewn along the free edges of the bottom and top sheets of the institutional bedding construction;

(g) a pair of tie straps having buckles thereon for back tying the free end of the straps to the body of the straps, one end of which is sewn along the bottom of the foot portion of the institutional bedding construction, so that when the bedding is rolled up the tie straps may be looped thereabout and tied to keep the bedding in a rolled up condition for storage purposes and to prevent soiling of the inside thereof during storage;

(h) a portion having multiple folded sections at the foot of said construction whereby the foot portion can expand to accomodate the user's feet without any substantial restriction thereto, wherein said foot portion of said construction includes:

(i) a flat top sheet having a generally rectangular foot portion;

(j) a first fold having a pair of fold lines substantially parallel to one side edge thereof whereby a portion of said side edge is tucked under a portion of said sheet;

(k) a second fold having a pair of fold lines substantially parallel to the side edge of said sheet which is oppositely disposed in parallel relationship to said first fold whereby a portion of said side edge is tucked under a portion of said sheet;

(l) a third fold having a pair of fold lines substantially parallel to the bottom edge of said sheet which is disposed in substantial perpendicularity with said first and second folds herein;

(m) a pair of corner folds the outer facing edge of which is disposed at a substantially forty-five degree angle with respect to the edge formed along the bottom of said folded sheet; and (n) means for securing said foled portion of said sheet in substantially fixed position relative to each other of said folds after folding to form an expandable foot bag for said construction.

* * * * *